US007748123B2

(12) United States Patent
Bednar

(10) Patent No.: US 7,748,123 B2
(45) Date of Patent: Jul. 6, 2010

(54) ELECTRIC HAIR CUTTING APPLIANCE WITH COUNTER WEIGHT

(75) Inventor: Thomas Richard Bednar, Pewaukee, WI (US)

(73) Assignee: Rovcal, Inc., Madison, WI (US)

( * ) Notice: Subject to any disclaimer, the term of this patent is extended or adjusted under 35 U.S.C. 154(b) by 797 days.

(21) Appl. No.: 11/468,985

(22) Filed: Aug. 31, 2006

(65) Prior Publication Data

US 2008/0052914 A1 Mar. 6, 2008

(51) Int. Cl.
*B26B 19/02* (2006.01)
*B26B 19/06* (2006.01)

(52) U.S. Cl. ..... 30/216; 30/44; 30/210; 30/223

(58) Field of Classification Search ..... 30/44, 30/216, 210, 223, 43, 43.7, 222, 208, 43.9, 30/224; 74/37, 44
See application file for complete search history.

(56) References Cited

U.S. PATENT DOCUMENTS

| | | | | |
|---|---|---|---|---|
| 2,799,925 | A * | 7/1957 | Lattin | 30/43.9 |
| 3,791,030 | A * | 2/1974 | Jackson et al. | 30/43.9 |
| 3,872,587 | A | 3/1975 | Wellinger | |
| 4,660,283 | A | 4/1987 | Yasunaka | |
| 4,914,816 | A | 4/1990 | Fenn et al. | |
| 5,099,705 | A | 3/1992 | Dravnieks | |
| 5,207,731 | A | 5/1993 | Bukoschek | |
| 5,235,749 | A | 8/1993 | Hildebrand et al. | |
| 5,343,621 | A | 9/1994 | Hildebrand et al. | |
| 5,678,312 | A | 10/1997 | Watanabe | |
| 6,098,288 | A | 8/2000 | Miyagawa et al. | |
| 6,226,871 | B1 | 5/2001 | Eichhorn et al. | |
| 6,357,117 | B1 | 3/2002 | Eichhorn et al. | |
| 6,378,210 | B1 | 4/2002 | Bickford | |
| 6,421,922 | B2 * | 7/2002 | Beutel et al. | 30/216 |
| 6,481,104 | B1 | 11/2002 | Parker et al. | |
| 2001/0015016 | A1 | 8/2001 | Pragt | |

FOREIGN PATENT DOCUMENTS

| | | |
|---|---|---|
| EP | 1003630 A1 | 5/2000 |
| JP | 54053061 | 4/1979 |
| JP | 54076358 | 6/1979 |
| JP | 2109588 | 4/1990 |
| JP | 2161981 | 6/1990 |
| JP | 2215492 | 8/1990 |
| JP | 3055089 | 3/1991 |
| JP | 5137854 | 6/1993 |
| JP | 5168775 | 7/1993 |
| JP | 6000258 | 1/1994 |
| JP | 6000259 | 1/1994 |
| JP | 6327855 | 11/1994 |
| JP | 7313746 | 5/1995 |
| JP | 7265560 | 10/1995 |
| JP | 8126785 | 5/1996 |

* cited by examiner

*Primary Examiner*—Ghassem Alie
(74) *Attorney, Agent, or Firm*—Armstrong Teasdale, LLP

(57) ABSTRACT

A hand-held hair cutting appliance has a housing, a first cutting blade, and a second cutting blade. The first cutting blade is capable of reciprocating movement relative to the housing. A drive assembly is operatively connected to the first cutting blade for drivingly reciprocating the first cutting blade relative to the housing. A counter weight is adapted for reciprocating movement relative to the housing in response to reciprocating movement of the first cutting blade. The counter weight has at least one of a mass and a location relative to the first cutting blade to thereby at least partially counter-balance the reciprocating movement of the first cutting blade.

6 Claims, 12 Drawing Sheets

ELECTRIC HAIR CUTTING APPLIANCE WITH COUNTER WEIGHT

FIELD OF THE INVENTION

The present invention generally relates to electric hand-held hair cutting appliances such as are used for hair trimming, clipping and shaving, and particularly to such electric hand-held hair cutting appliances having a reduced vibration level during operation.

BACKGROUND OF THE INVENTION

Electric hand-held hair cutting appliances come in a number of different forms depending on the intended use of the appliance, such as for trimming facial or body hair, clipping the hair on one's head or on a pet, or for shaving facial or body hair. Such hair cutting appliances typically have at least one stationary blade and at least one reciprocating blade operatively connected to an eccentric drive assembly such that rotation of the drive assembly linearly reciprocates the reciprocating blade relative to the stationary blade. It is common for the drive assembly to be housed in a handle of the appliance while the reciprocating blade and stationary blade comprise part of a blade head assembly that is removably attachable to the handle to permit cleaning and replacement of the blade head assembly. It is also now common for hair cutting appliances to be sold as kits that include a single handle having the drive assembly therein, and interchangeable blade head assemblies wherein the blade head assemblies have different size reciprocating blades or are otherwise configured for different purposes.

During operation of these hand-held hair cutting appliances, the linear reciprocation of the reciprocating blade often generates an inertial moment within the appliance that results in the appliance vibrating within the user's hand. Depending on the particular location of the center of mass of the reciprocating blade relative to the point of driving connection with the drive assembly, substantial vibration may occur.

Attempts to reduce the vibration level have revolved around providing counter weight on the rotating eccentric drive assembly to counter balance the vibration caused by the reciprocating cutting blade. While this can reduce vibration of the system in the direction of reciprocating blade movement, it creates vibration in other directions. In addition, because the counter weight is retained in the handle, it is adapted only to counter-balance one particular blade head assembly arrangement. For example, for appliances that are intended to be used with multiple interchangeable blade head assemblies, the reciprocating cutting blades of the different blade assemblies are typically of different mass and/or location within the respective assemblies and thus the center of mass of such blades varies from one blade head assembly to the next. As such, providing a counter weight on the drive assembly in the handle may reduce vibration only for the blade head assembly to which the counter weight arrangement corresponds. When other blade head assemblies are used (e.g., having different size, mass, etc.), the counter weight arrangement in the handle is no longer tuned to the particular blade head assembly being used and the benefits of the counter weight arrangement are substantially lost.

There is a need, therefore, for an electrically operated hand-held hair cutting appliance with an improved counter weight system to reduce vibration during use.

SUMMARY OF THE INVENTION

In one aspect, a hand-held hair cutting appliance generally comprises a housing, a first cutting blade, and a second cutting blade. The first cutting blade is capable of reciprocating movement relative to the housing. A drive assembly is operatively connected to the first cutting blade for drivingly reciprocating the first cutting blade relative to the housing. A counter weight is adapted for reciprocating movement relative to the housing in response to reciprocating movement of the first cutting blade. The counter weight has at least one of a mass and a location relative to the first cutting blade to thereby at least partially counter-balance the reciprocating movement of the first cutting blade.

In another aspect, a blade head assembly for a hand-held hair cutting appliance generally comprises a handle, a drive assembly disposed at least in part within the handle and held in assembly therewith, and the blade head assembly. The blade head assembly is removably attachable to the handle in operative connection with the drive assembly. The blade head assembly generally comprises a blade head assembly housing, a first cutting blade and a second cutting blade. The first and second cutting blades are held in assembly with the blade head assembly housing for attachment and detachment from the handle with the blade head assembly. The first cutting blade is capable of reciprocating movement relative to the blade head assembly housing. The blade head assembly is arranged and configured such that upon attachment of the blade head assembly to the handle of the hair cutting appliance the first cutting blade is operatively connected to the drive assembly. A counter weight is held in assembly with the blade head assembly housing and is adapted for reciprocating movement relative thereto in response to reciprocating movement of the first cutting blade to thereby at least partially counter-balance the reciprocating movement of the first cutting blade.

A hair cutting kit according to one embodiment generally comprises a handle, a drive assembly held in assembly with the handle, and a first blade head assembly removably attachable to the handle. The first blade head assembly comprises a first blade head assembly housing and first and second cutting blades held in assembly with the first blade head assembly housing. The first cutting blade is capable of reciprocating movement relative to the first blade head assembly housing. The first blade head assembly is arranged and configured such that upon attachment of the first blade head assembly to the handle the first cutting blade is operatively connected to the drive assembly. A first counter weight is held in assembly with the first blade assembly housing and is adapted for reciprocating movement relative to the first blade head assembly housing in response to reciprocating movement of the first cutting blade to thereby at least partially counter-balance the reciprocating movement of the first cutting blade. A second blade head assembly separate from the first blade head assembly is removably attachable to the handle when the first blade assembly is detached from the handle. The second blade head assembly is constructed different from the first blade head assembly. The second blade head assembly comprises a second blade head assembly housing and third and fourth cutting blades held in assembly with the second blade head assembly housing. The third cutting blade is capable of reciprocating movement relative to the second blade head assembly housing. The second blade head assembly is arranged and configured such that upon attachment of the second blade head assembly to the handle the third cutting blade is operatively connected to the drive assembly.

BRIEF DESCRIPTION OF THE DRAWINGS

Corresponding reference characters indicate corresponding parts throughout the drawings.

DETAILED DESCRIPTION

Figure 1:
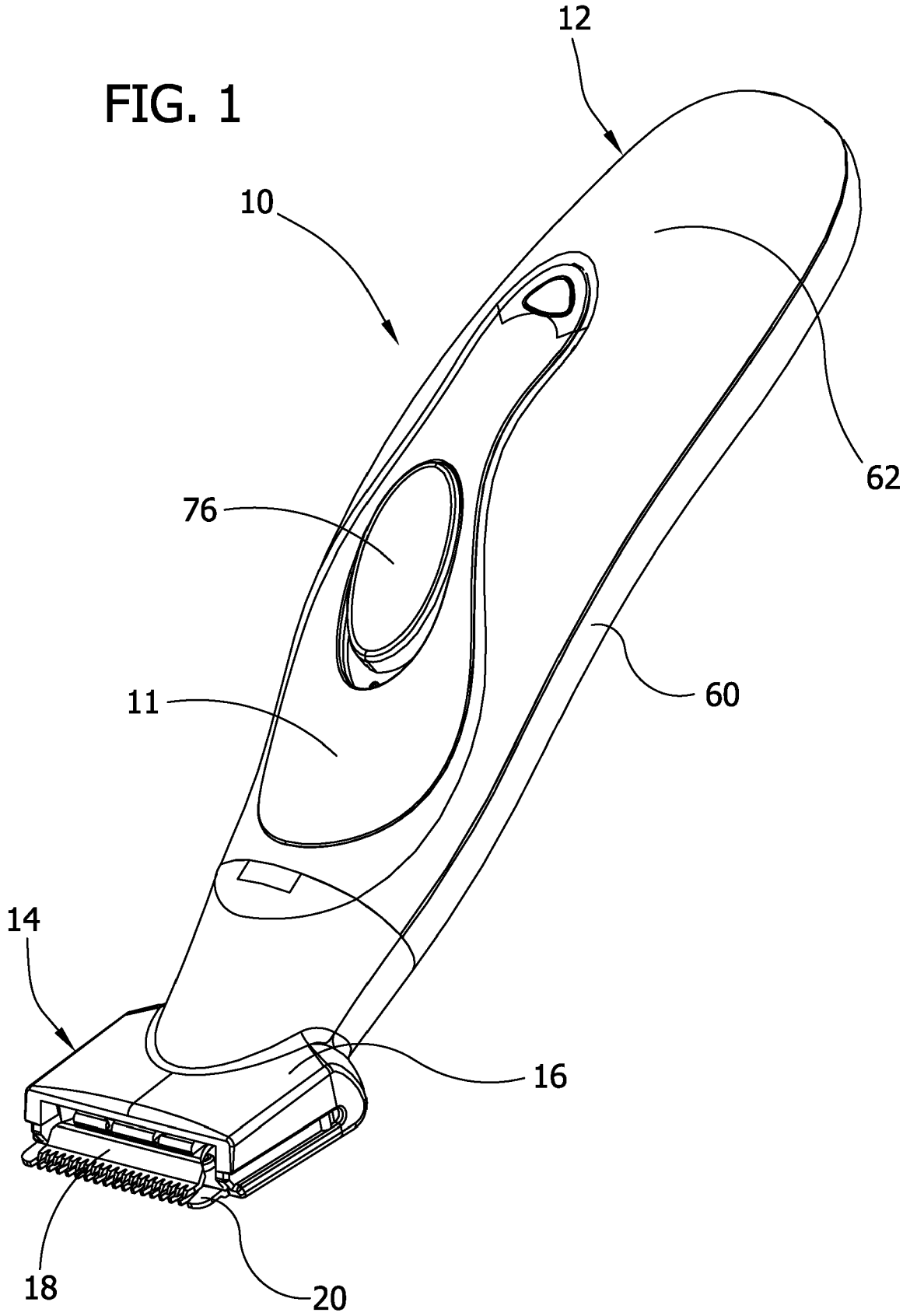
FIG. 1 is a perspective view of one embodiment of a hand-held hair cutting appliance of the present invention in the form of an electrically operated hair trimmer having a handle and a blade head assembly removably attached to the handle.
Figure 1A:
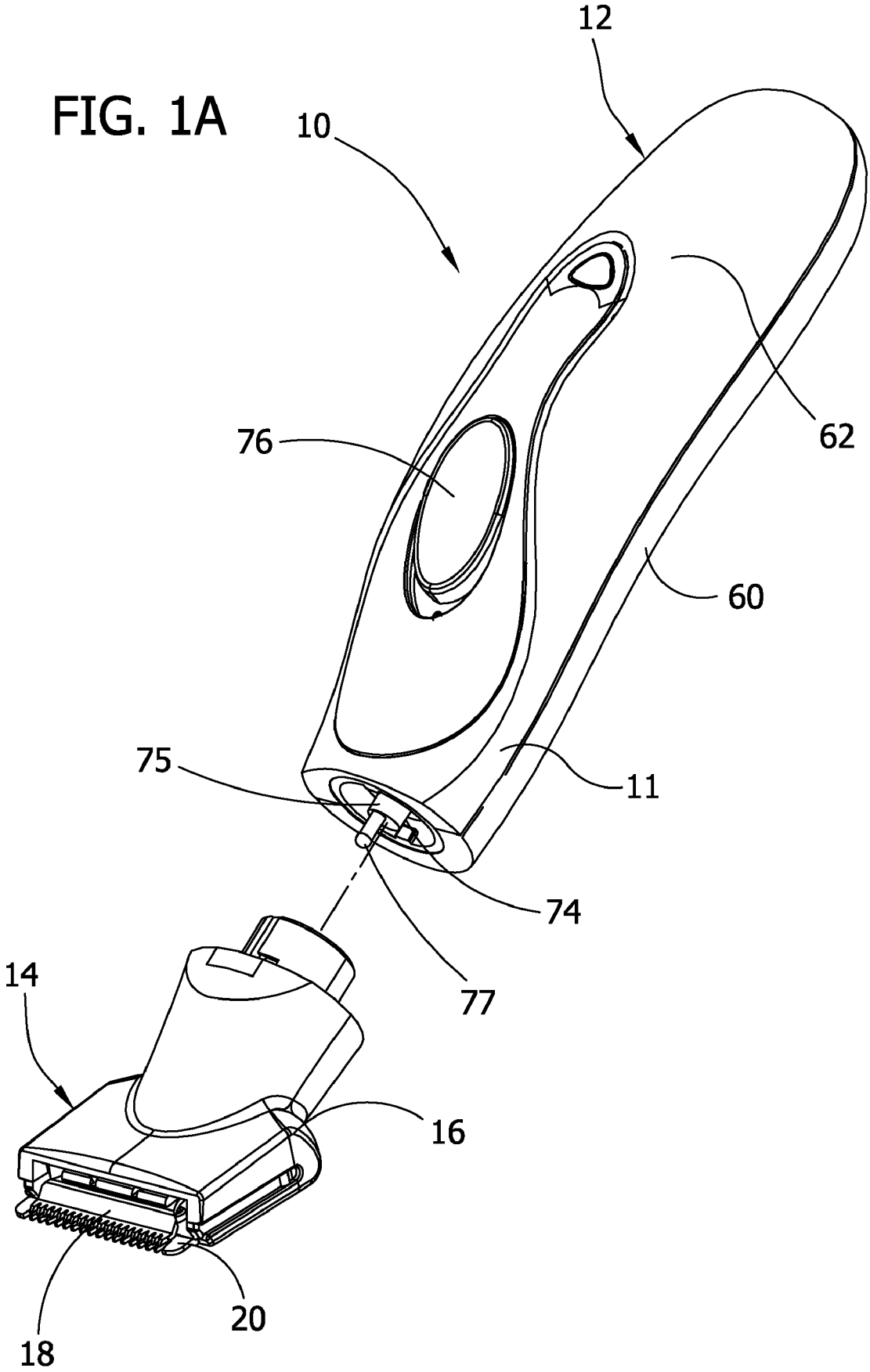
FIG. 1A is a perspective view of the hair trimmer of FIG. 1 with a blade head assembly detached from a handle of the appliance.
Figure 2:
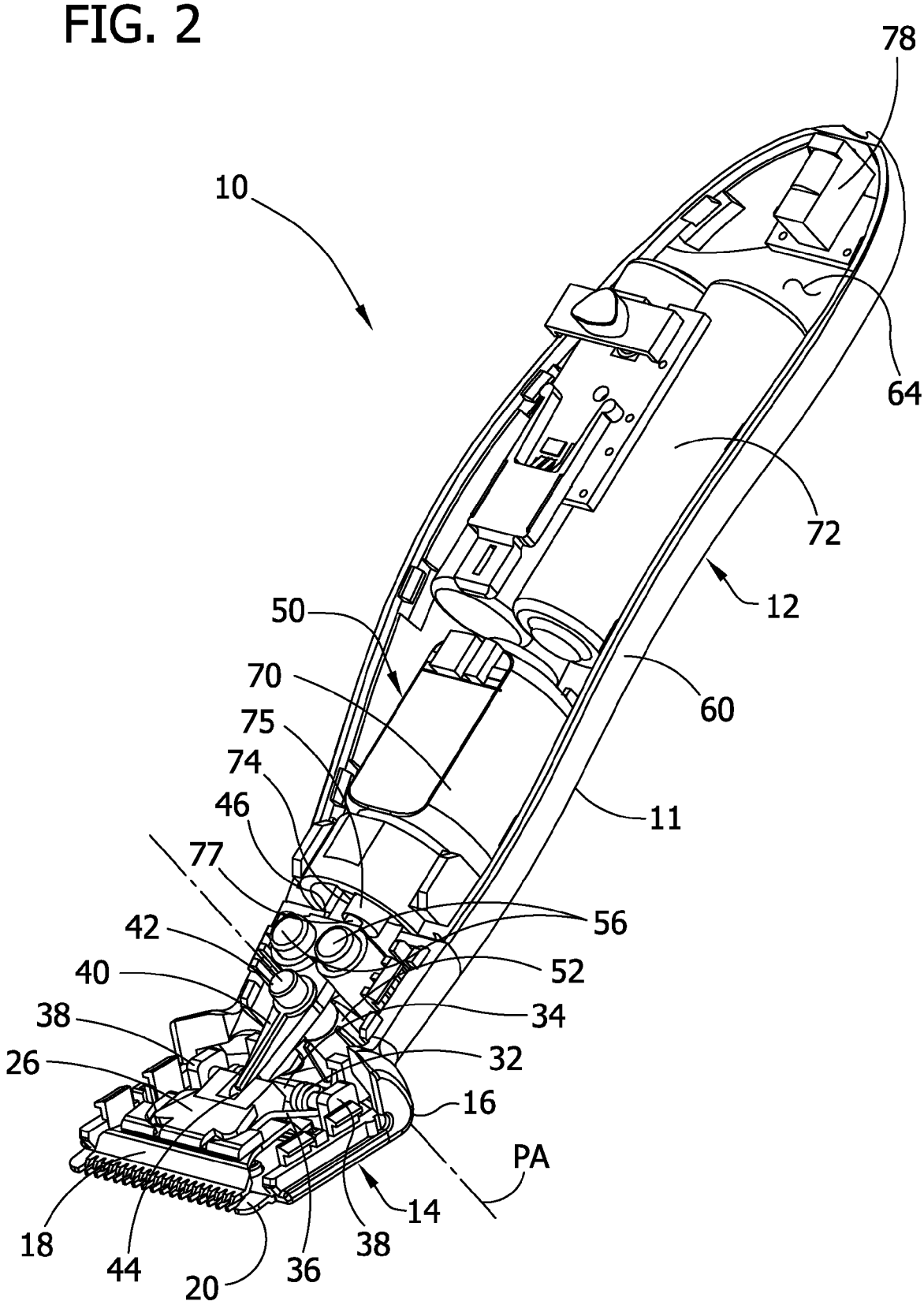
FIG. 2 is a perspective view of the hair trimmer of FIG. 1 with parts removed to reveal internal construction of the hair trimmer.

Referring now to the drawings and in particular to FIGS. 1, 1A and 2, in one embodiment of an electric hand-held hair cutting appliance, generally indicated at 10, the appliance is particularly configured for use as a hair trimmer to trim facial or body hair. However, it is understood that the hair cutting appliance 10 may be configured for other uses such as hair clipping, shaving and the like as described later herein without departing from the scope of this invention.

The hair cutting appliance 10 broadly comprises a handle, indicated generally at 12, and a blade head assembly (e.g., configured for hair trimming), indicated generally at 14, with the handle and blade head assembly together broadly defining a housing 11 for the hair trimmer. In the illustrated embodiment, the blade head assembly is removably attachable to the handle to permit selective attachment and detachment of the blade head assembly from the handle for cleaning, replacement or interchangeability with other types of blade head assemblies. It is understood, however, that the blade head assembly may be more permanently attached to the handle (e.g., not intended for removal from the handle) without departing from the scope of this invention.

The handle 12 is suitably sized and shaped so that it is easily held in a user's hand. The illustrated handle 12 is elongate and relatively cylindrical and is of two-piece construction including a base 60 and a cover 62 (see FIG. 1, the cover being removed in FIG. 2) affixed to the base to define an interior space 64 of the handle. The illustrated base 60 and cover 62 of the handle 12 are constructed of a light-weight, rigid plastic but it is contemplated that the base and/or cover could alternatively be made from other suitable materials. It is also understood that the handle 12 may be suitably shaped other than as illustrated in FIG. 1 as long as the handle is sized and shaped for being held in a user's hand.

As illustrated in FIG. 2, the hair cutting appliance 10 further comprises a drive assembly, generally indicated at 50, disposed and held within the interior space 64 of the handle 12. In one embodiment, the drive assembly 50 is more suitably an eccentric drive assembly comprised of an electric drive motor 70 and an eccentric drive 74 (FIG. 1A) rotatably driven by the motor. In the illustrated embodiment, for example, the eccentric drive 74 comprises a drive cylinder 75 axially mounted on the drive shaft (not shown) of the motor 70 and a pin 77 that extends longitudinally outward from the drive cylinder at a location offset from the rotational axis of the drive cylinder (and hence of the draft shaft).

The eccentric drive 74 suitably extends longitudinally outward of the handle 12 for operative connection with the operating components of the blade head assembly 14 as will described in further detail later herein. It is understood, though, that a drive assembly other than an eccentric drive assembly 50 may be used to operate the blade head assembly 14 without departing from the scope of this invention. Also, while not illustrated in detail in the drawings, the handle 12 and blade head assembly 14 are in one embodiment suitably configured to provide a bayonet-type connection to removably attach the blade head assembly to the handle. However, any suitable connection may be used to removably attach the blade head assembly 14 to the handle 12 and remain within the scope of this invention.

As used herein, the term electrical in reference to the electrical hair cutting appliance 10 is intended to mean that the appliance (and in particular the drive motor 70) may be operated by an external source of electrical power, or that the appliance may carry an internal power source such as one or more batteries (disposable or rechargeable). For example, in the illustrated embodiment, a pair of rechargeable batteries 72 (FIG. 2) are disposed within the handle 12 in electrical communication with the drive motor 70. The drive assembly 50 (i.e., the appliance 10) can be selectively turned on and off to using an on/off switch 76 mounted on the handle 12 and accessible exterior thereof. The batteries 72 can be recharged via a port 78 adapted to receive a plug of a charger (not shown).

Figure 3A:
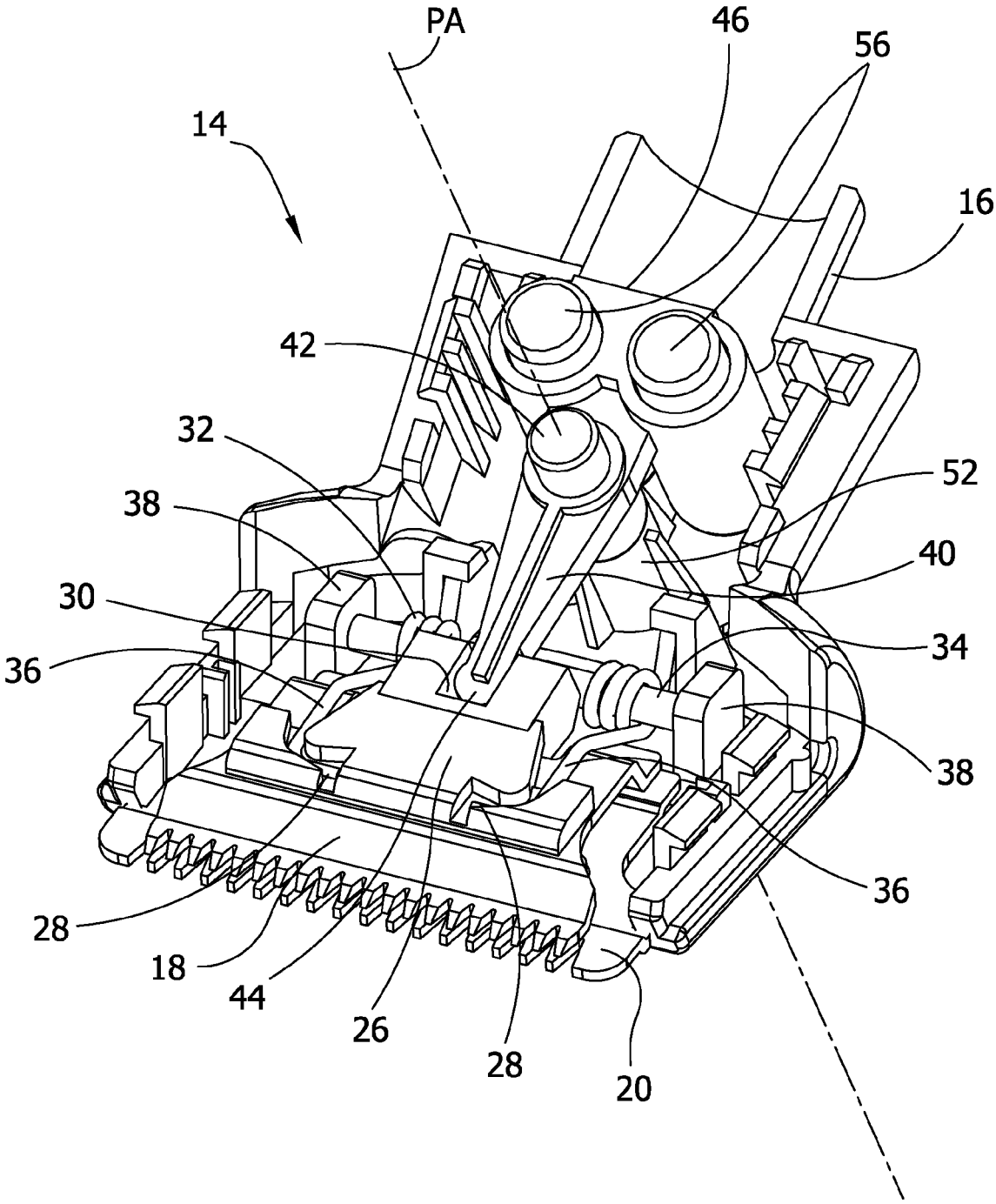
FIG. 3A is an enlarged front perspective view of the blade head assembly of the hair trimmer of FIG. 1 with parts removed to reveal internal construction.
Figure 3B:
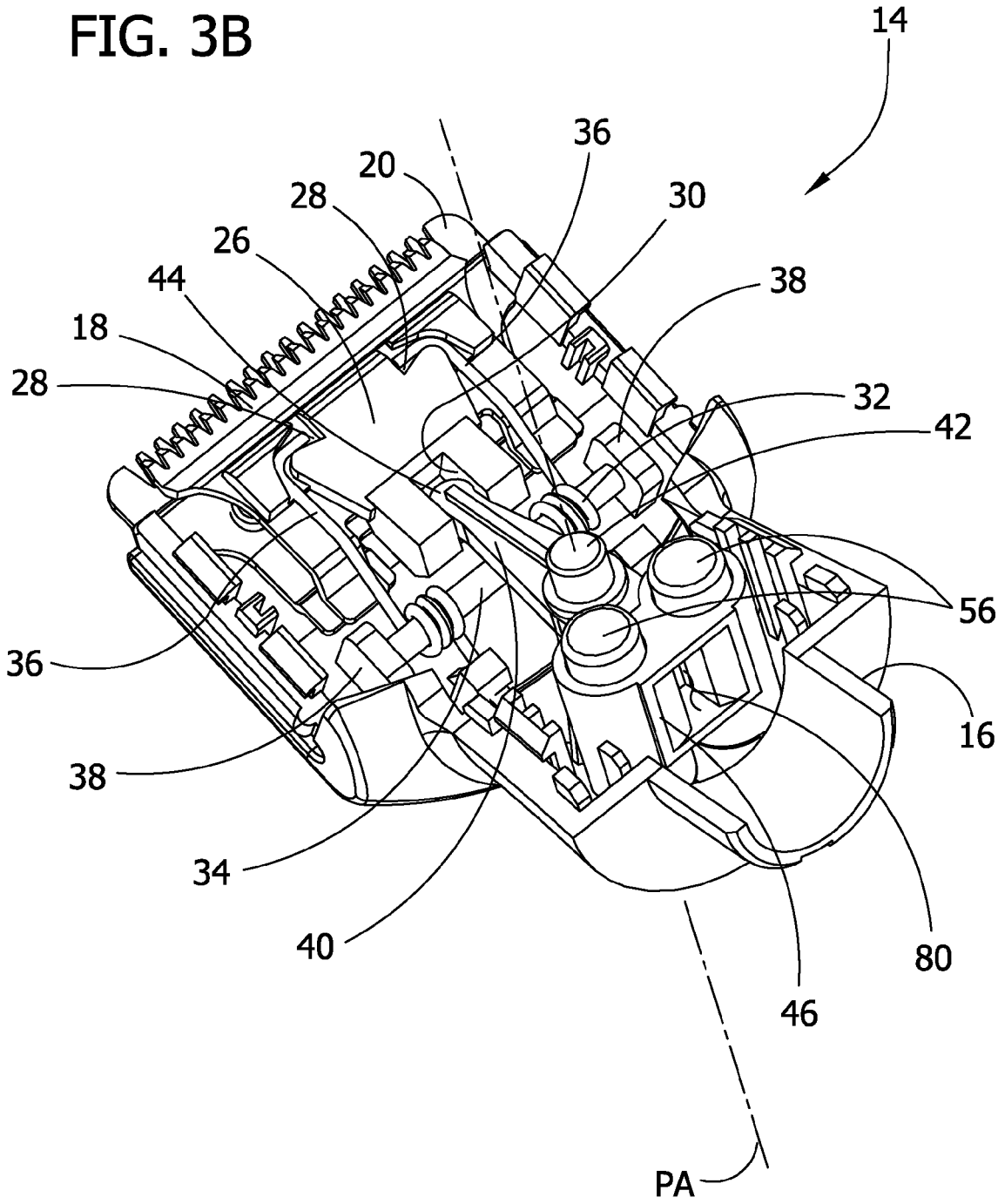
FIG. 3B is an enlarged rear perspective view of the blade head assembly of FIG. 3A with parts removed to reveal internal construction.
Figure 4:
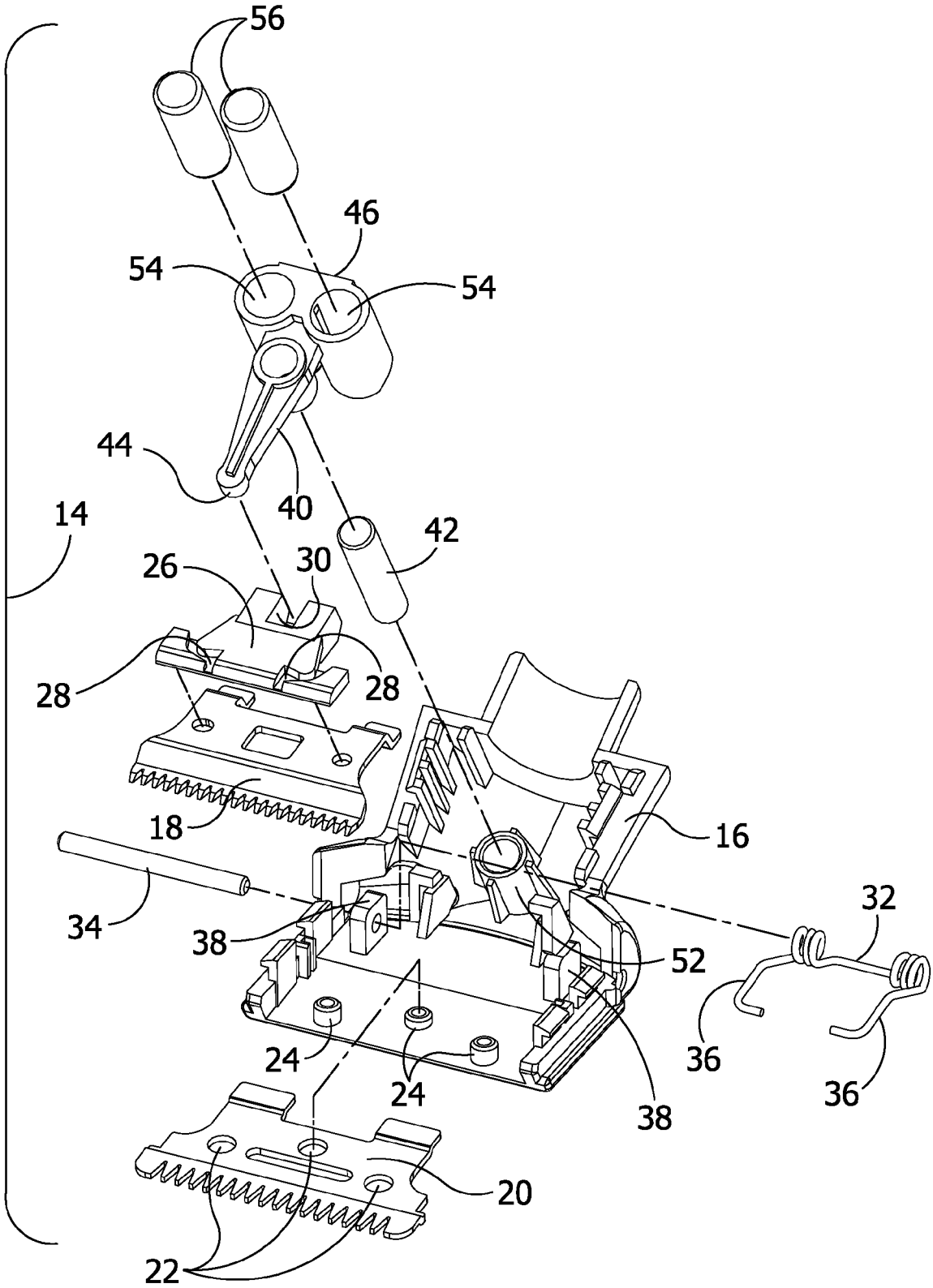
FIG. 4 is an exploded perspective view of the blade head assembly of FIG. 3A.

With reference now to FIGS. 3A, 3B and 4, the blade head assembly 14 comprises a cover 16 and a pair of cutting blades 18, 20 disposed in part within the cover and extending in part exterior of the cover for trimming hair. In the illustrated embodiment, the cutting blades comprise a reciprocating blade 18 (broadly, a first cutting blade) that is capable of reciprocating movement relative to the cover 16 (and hence the housing 11 of the appliance 10) and a stationary blade 20 (broadly, a second cutting blade) that is secured against movement relative to the cover 16 adjacent to and in face-to-face relationship (and more suitably sliding face-to-face contact) with the reciprocating blade. For example, the stationary blade 20 of FIG. 4 includes three openings 22 for receiving a corresponding set of three guide posts 24 formed on the cover 16 to properly position and secure the stationary blade on the cover. It is contemplated that the second cutting blade 20 may also be capable of reciprocating movement relative to the cover 16 instead of being stationary. It is also understood that the hair cutting appliance 10 may have more than one reciprocating cutting blade and one or more stationary blades without departing from the scope of this invention.

The reciprocating blade 18 is secured to a cross-bar portion of a generally "T" shaped connector 26 (FIG. 4) for use in operatively connecting the reciprocating blade to the drive assembly 50. Accordingly, it will be understood that the term reciprocating blade or cutting blade as used in reference to the reciprocating blade 18 is intended to broadly refer to the reciprocating blade and, if present, to any structure to which the blade is secured for conjoint reciprocation with the blade 50. A spring member 32 is mounted on a transversely extending rod 34 (i.e., with the rod mounted on the cover by suitable supports 38) and is connected to the connector 26 to continually bias the reciprocating blade 18 against the stationary blade 20. In particular, the illustrated connector 26 includes a pair of generally arcuate channels 28 formed therein for receiving and retaining extension arms 36 of the spring member 32 to thereby connect the spring member to the connector (and hence to the reciprocating blade 18), and a slot 30 (FIG. 3B) formed in the end of the extension portion of the T-shaped connector for purposes which will become apparent.

A pivot link 40 operatively connects the reciprocating blade 18 with the drive assembly 50 to convert the rotary motion of the eccentric drive assembly into generally transverse linear reciprocating motion of the reciprocating blade. In particular, the pivot link 40 is suitably pivotably mounted on the cover 16 of the blade head assembly 14 for reciprocating pivoting movement relative thereto during operation of the hair trimmer 10. In the embodiment illustrated in FIGS. 3 and 4, a socket 52 is formed in the cover and retains (e.g., by friction or interference fit) an elongate pin 42. The pivot link 40 is generally elongate, having a longitudinal axis (not shown), longitudinally opposite ends 44 and 46, and an opening intermediate these longitudinal ends for seating the pivot link on the pin 42 to thereby pivotably mount the pivot link on the pin.

Accordingly, the pin 42 defines a pivot axis PA of the pivot link 40, with this pivot axis suitably extending other than in the side-to-side direction in which the reciprocating blade 18 is intended to reciprocate. A first longitudinal segment of the pivot link 40 extends along its longitudinal axis away from the pivot axis PA to the one end 44 of the pivot link and a second longitudinal segment of the pivot link extends along its longitudinal axis away from the pivot axis PA to the opposite end 46 of the pivot link (i.e., in a direction opposite the direction in which the first segment extends.

In the illustrated embodiment, the first longitudinal segment of the pivot link 40 extends longitudinally from the pivot axis PA toward the reciprocating blade 18 with the end 44 of the pivot link seating within the slot 30 formed in the connector 26 to operatively connect the reciprocating blade to the pivot link. In particular, the end 44 of the pivot link 40 is pivotally received within the slot 30 to permit pivoting movement of the pivot link relative to the connector 26 (and hence the blade 18) so that reciprocating pivoting movement of the pivot link about the pivot axis PA results in translating, or generally linear, reciprocating movement of the reciprocating blade. In such an arrangement, a center of mass CMB (FIG. 5) of the reciprocating blade 18 is longitudinally spaced from the pivot axis PA such that reciprocating motion of the reciprocating blade 18 generates an inertial moment at the pivot axis PA.

In a particularly suitable embodiment, a counter weight 56 is provided to counter-balance the inertial moment generated by the reciprocating blade. More suitably, such a counter weight 56 is capable of reciprocating movement relative to the cover 16 (i.e., relative to the housing 11) in response to reciprocating movement of the reciprocating blade 18. Even more suitably, the counter weight 56 is held in assembly with reciprocating blade 18.

As an example, in the illustrated embodiment the opposite (second) longitudinal segment of the pivot link 40 (e.g., extending from the pivot axis PA to the longitudinal end 46 of the pivot link) supports a counter weight 56. In such an arrangement, the counter weight 56 is capable of reciprocating movement relative to the cover 16 of the blade head assembly 14 (and hence relative to the housing 11 of the hair cutting appliance 10), and in particular the counter weight reciprocates as the pivot link is pivoted about the pivot axis PA to reciprocate the reciprocating blade 18. More suitably, a slot 80 (FIG. 3B) is formed in the end 46 of the pivot link 40 for receiving the pin 77 of the eccentric drive 74 therein upon attachment of the blade head assembly 14 to the handle 12 to operatively connect the pivot link (and hence to operatively connect the reciprocating blade via its operative connection with the pivot link) to the drive assembly 50. In particular, the slot 80 is suitably sized relative to the pin of the eccentric drive 74 such that upon rotation of the eccentric drive 74 by the drive motor 70 the pin 77 of the eccentric drive reciprocatingly drives the end 46 of the pivot link 40 side-to-side to reciprocatingly pivot the pivot link 40 about its pivot axis PA.

In the illustrated embodiment, along the segment of the pivot link 40 that extends from the pivot axis PA to the longitudinal end 46 (e.g., the longitudinal end opposite the end toward which the reciprocating blade 18 is disposed), and more suitably generally at the end 46 of the pivot link, a pair of generally cylindrical cavities 54 are formed integrally with the pivot link. A pair of metal pegs, together defining the counter weight 56 is seated and secured (e.g., by friction or interference fit) within these cavities 54 to hold the counter weight in assembly with the pivot link 40, and thereby in assembly with the reciprocating blade 18. It is understood that the counter weight 56 may be located other than at the end 46 of the pivot link, such as anywhere along the segment of the pivot link between the pivot axis PA and the end of the pivot link, without departing from the scope of this invention.

Figure 5:
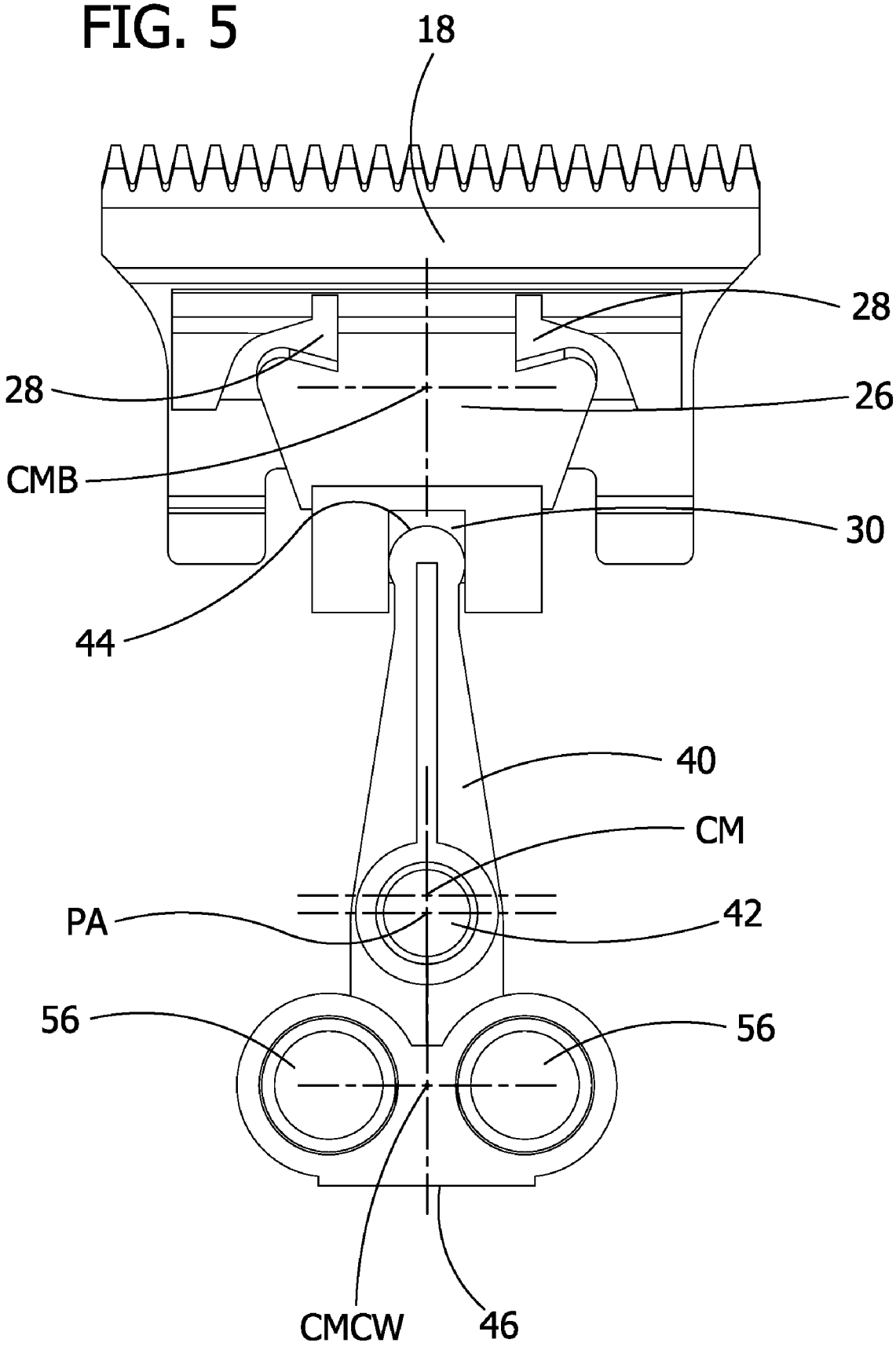
FIG. 5 is a plan view of a reciprocating blade and a counter weight of the blade head assembly, the counter weight being operatively connected to the reciprocating blade via a pivot link.

In particular, the counter weight 56 has a suitable mass, and is located along the pivot link 40 at a location (e.g., a distance) relative to the pivot axis PA to substantially counter-balance the mass and location of the reciprocating blade 18 relative to the pivot axis (FIG. 5). That is, the inertial moment generated by the mass of the reciprocating blade 18 and the length of its associated moment arm defined from the pivot axis PA of the pivot link 40 to the center of mass CMB of the reciprocating blade is substantially counter-balanced (e.g., counter-acted) by the inertial moment generated by the mass of the counter weight 56 and the associated moment arm defined by the pivot axis of the pivot link and the center of mass CMCW of the counter weight. Otherwise stated, the mass and location of the counter weight 56 relative to the pivot axis PA is such that a center of mass CM of the combination of the reciprocating blade 18, pivot link 40 and counter weight 56 is at or at least generally adjacent the pivot axis PA.

In the illustrated embodiment, the counter weight 56 is located longitudinally nearer to the pivot axis PA than the reciprocating cutting blade 18. Accordingly, in such an embodiment the counter weight 56 suitably has a mass greater than the mass of the reciprocating cutting blade 18. However, it is contemplated that in other embodiments the counter weight 56 may be more distal from the pivot axis PA than the reciprocating blade 18, they may be equidistant. In such an embodiment, the counter weight may respectively have a mass that is less than or equal to the mass of the reciprocating blade.

While in the illustrated embodiment the counter weight 56 is held in assembly with the reciprocating blade 18 by the pivot link 40, it is contemplated that in alternative embodiments the counter weight need not be held in assembly with the reciprocating blade to remain within the scope of this invention as long as the counter weight is arranged to reciprocate in response to reciprocating movement of the reciprocating blade and is of sufficient mass and location relative to the pivot axis PA to counter-balance the inertial moment generated by the reciprocating blade.

In operation of the hair cutting appliance 10, and in particular the appliance illustrated in FIG. 1 having a blade head assembly 14 configured for trimming hair, the operator turns on the appliance using the on/off switch 76, which allows the batteries 72 to supply electrical power to the electric motor 70 of the drive assembly 50. The electric drive motor 70 drivingly rotates the eccentric drive 74 which, in view of the operative connection between the end 46 of the pivot link 40 and the pin 77 of the eccentric drive causes the pivot arm 40 to reciprocatingly pivot about the pivot axis PA defined by the pin 42. As the pivot link 40 is pivoted in this manner, the reciprocating blade 18, in view of its operative connection with the pivot link via the connector 26, reciprocates side-to-side (i.e., it reciprocates generally linearly in a transverse direction).

Because the counter weight 56 is held in assembly with the pivot link 40, and more particularly with the reciprocating blade 18, the counter weight reciprocates generally side-to-side along an arcuate path defined by the distance of the counter weight from the pivot axis PA in response to reciprocation of the reciprocating blade. However, because the counter weight 56 is located on the longitudinally opposite side of the pivot axis PA from the reciprocating blade 18, as the reciprocating blade is moved transversely in one direction the counter weight 56 moves generally transversely in the opposite direction. As a result, the inertial moment generated by the counter weight 56 generally balances (e.g., cancels or counter-acts) the inertial moment generated by the reciprocating blade 18. The hair cutting appliance 10 therefore experiences a reduced level of vibration relative to a similar appliance without the counter weight 56.

Removably attaching the blade assembly head 14 to the handle 12 provides the ability to interchange different blade assembly heads on the handle 12 depending on the desired form of hair cutting to be achieved. For example, in one embodiment a hair cutting kit may comprise a hair cutting appliance such as the appliance 10 having the handle 12 and blade head assembly 14 illustrated in FIGS. 1-4. The mass and location of the counter weight 56 relative to the pivot axis PA corresponds particularly to the mass and location of the reciprocating blade 18 relative to the pivot axis PA only for that particular blade head assembly.

Such a kit further comprises one or more additional blade head assemblies, each individually removably attachable to the handle 12 in operative connection with the drive assembly 50. In one particularly suitable embodiment, a second blade head assembly (not shown) may also be configured for hair trimming similar to the assembly 14 of FIGS. 3 and 4, but with the reciprocating blade of the second blade assembly being constructed different, such as in size and/or material, from the reciprocating blade 18 of the blade head assembly 14. For example, it is common to vary the cutting width provided by hair trimmers by providing head assemblies having reciprocating blades 18 of different lengths.

Changing the blade 18 length or material of construction changes the mass and/or the center of mass of the blade and, if the blade is of a different configuration, the location of the blade relative to the pivot axis PA may also change. To account for a change in mass or location due to the different construction of the reciprocating blade of such a second blade head assembly, at least one of the mass and the location of the counter weight relative to the pivot axis PA must be changed so as to maintain the desired counter balancing of the inertial moment generated by the reciprocating blade. That is, broadly stated, the counter weight arrangement (e.g., size/location) of this second blade head assembly particularly corresponds to the different reciprocating blade of this second blade head assembly.

Figure 6:
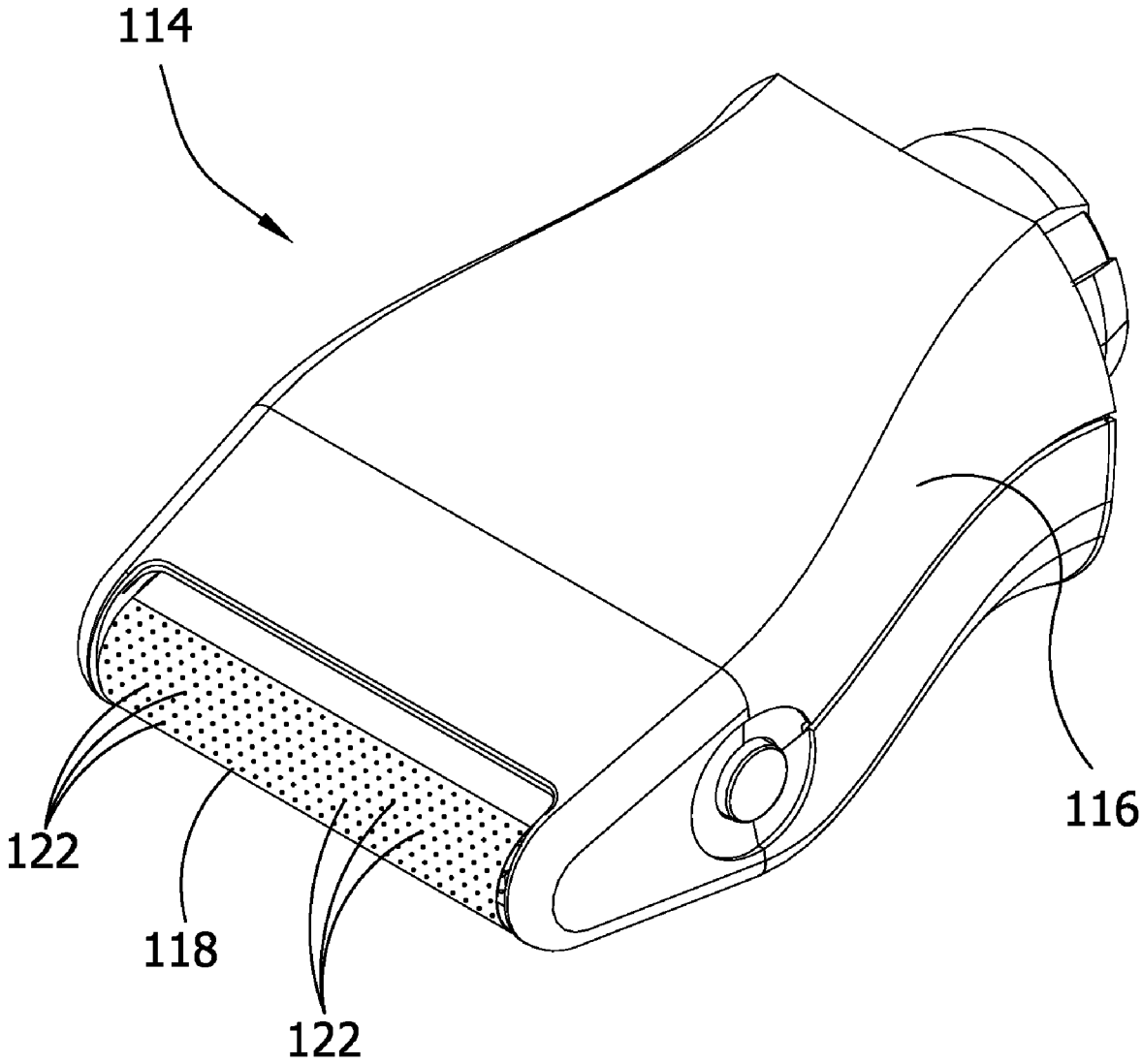
FIG. 6 is a perspective view of one alternative embodiment of a blade head assembly in the form of an electric foil shaver for use with the handle of the hair cutting appliance of FIG. 1.
Figure 7A:
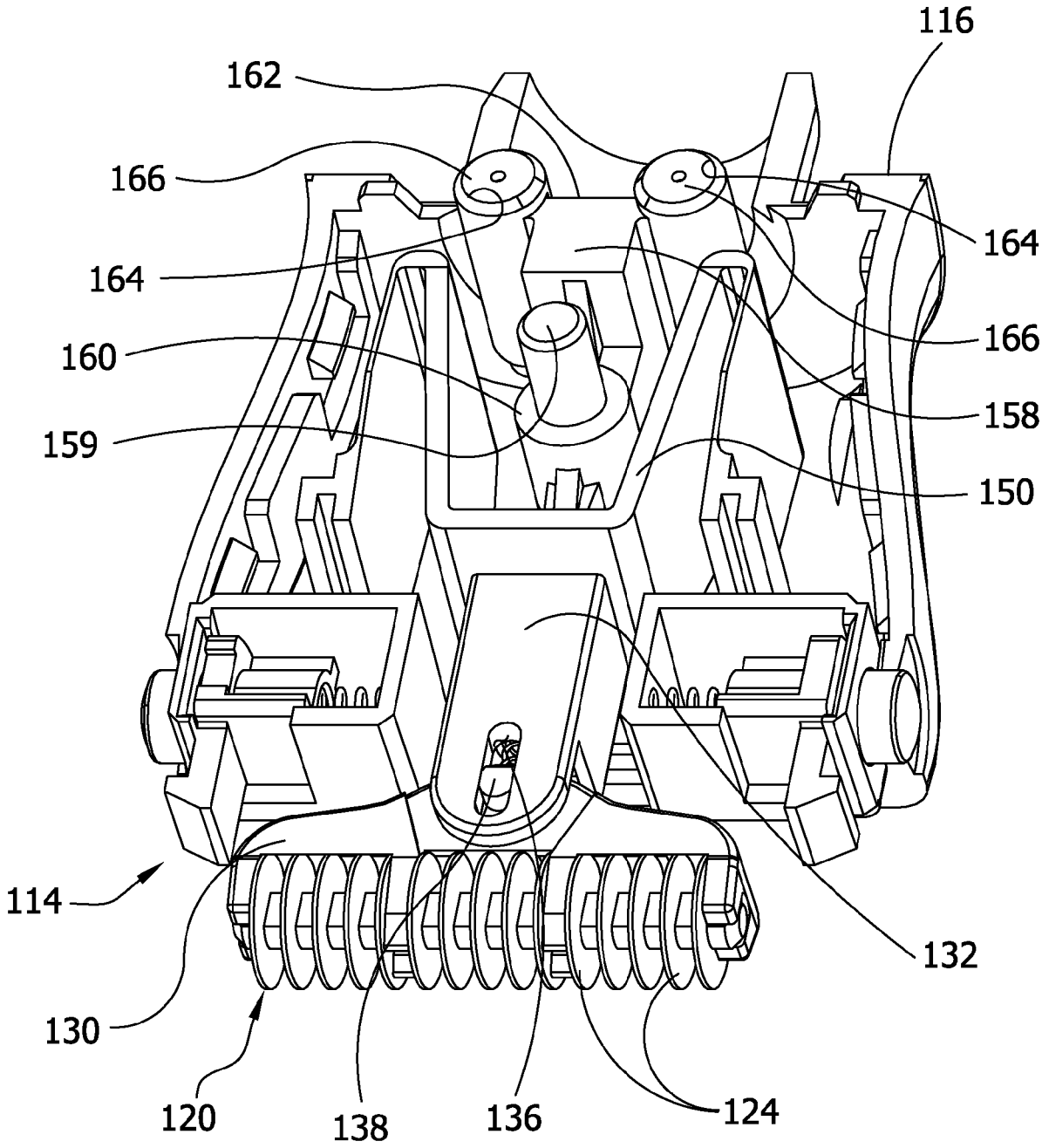
FIG. 7A is a front perspective view of the blade head assembly of FIG. 6 with parts removed to reveal internal construction.
Figure 7B:
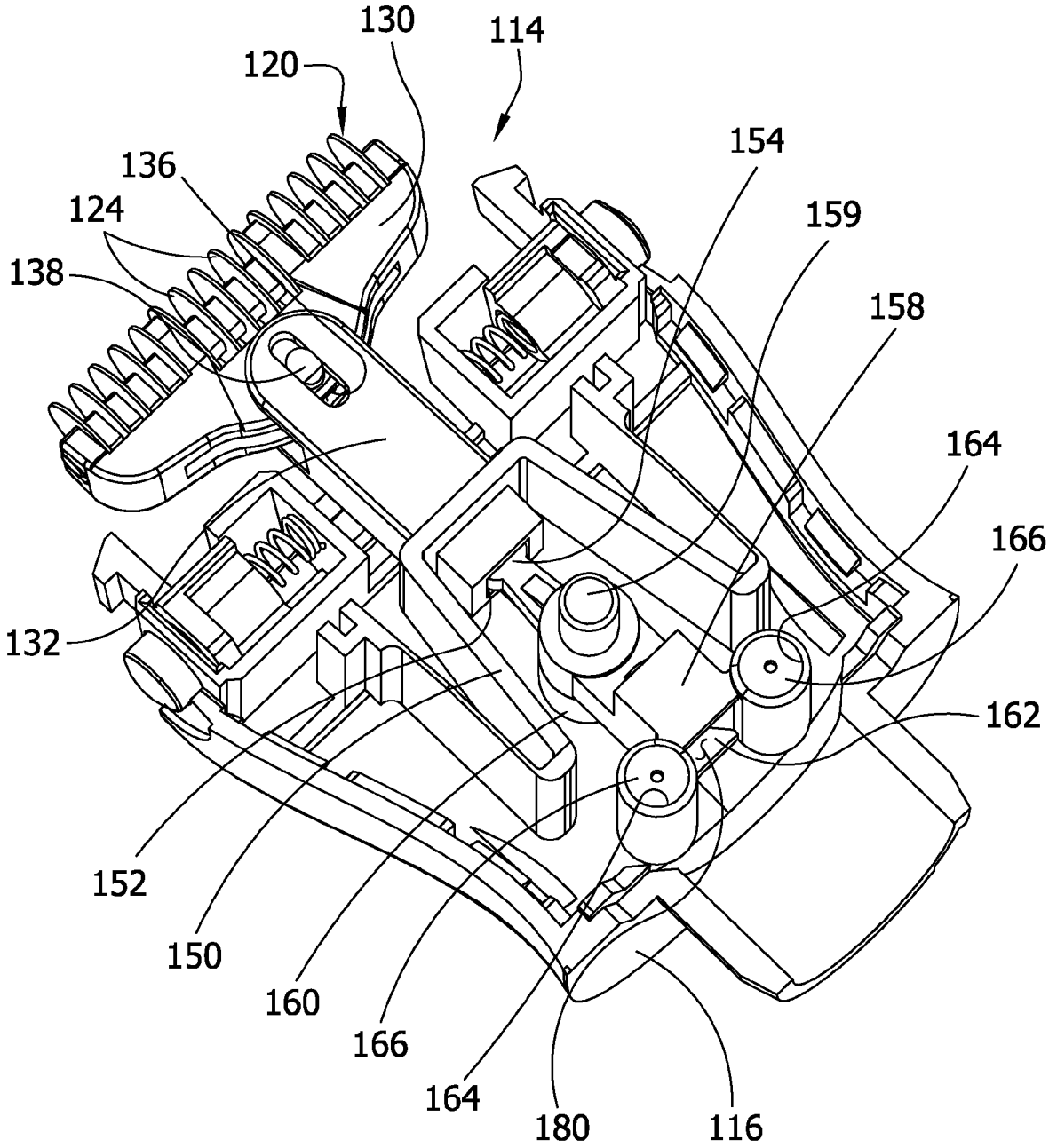
FIG. 7B is a rear perspective view of the blade head assembly of FIG. 6 with parts removed to reveal internal construction.

It is also contemplated that in other embodiments such a second blade head assembly may be configured other than for hair trimming, i.e., other than for a use similar to that of the first blade head assembly 14. For example, FIGS. 6, 7A and 7B illustrate an embodiment of a blade head assembly, indicated generally at 114, configured in the form of a foil shaver for shaving body or facial hair. As with the blade head assembly 14 of FIGS. 1-4, the blade head assembly 114 is adapted for removable attachment (e.g., by bayonet connection) to the handle 12 of the appliance illustrated in FIGS. 1 and 2.

The foil shaver blade head assembly 114 comprises a cover 116 (the cover 116 together with the handle 12 broadly defining the housing 11 of the appliance 10), an apertured foil 118 supported by and secured to the cover (e.g., the stationary blade, and more broadly a second cutting blade), and a cutting blade assembly 120 comprised of multiple cutting blades 124 mounted on a carriage 130 for reciprocating movement as a unit relative to the cover (and hence the foil) to shave hair. The cutting blade assembly 120 is considered herein to broadly define the reciprocating blade (and more broadly a first cutting blade). By sliding the outer surface of the foil 118 over the skin surface to be shaven, individual short hairs enter apertures 122 formed in the foil and are cut by the blades of the cutting blade assembly 120.

In the illustrated embodiment of FIGS. 7A and 7B, the carriage 130 is pivotably connected to a connecting post 132 for conjoint transverse movement therewith while allowing some pivoting movement of the carriage relative to the connecting post. For example, the carriage may be suitably pivotably connected to the connecting post by a pair of retention pins (one of which is illustrated in FIGS. 7A and 7B and indicated at 138) formed integrally with and on opposite sides of the carriage and received in corresponding elongate slots 136 formed in the connecting post. The end of the connecting post 132 longitudinally opposite the carriage 130 is in contact with a biasing member 150 that biases the carriage (and hence the reciprocating blade 120) toward the transverse center of the blade head assembly 114. For example, in the illustrated embodiment the biasing member 150 is a generally W-shaped strip of plastic having an opening through which the connecting post 132 passes. The resiliency provided by the W-shaped configuration of the biasing member 150 biases the connecting post 132 toward the transverse center of the blade head assembly 114, e.g., against the force of the eccentric drive 74 driving the transverse movement of the reciprocating blade 120.

A pivot link 158 similar to the pivot link 40 of FIGS. 1-4 is pivotably mounted on the cover 116, such as by a pin 159 seated within a socket 160 of the cover and defining a pivot axis of the pivot link. The longitudinal end of the connecting post 132 includes a cavity 152 formed therein for receiving a first longitudinal end 154 of the pivot link 158 to operatively connect the reciprocating blade 120 to the pivot link. A longitudinally opposite end (a second end) 162 of the pivot link 158 has a slot 180 formed therein for receiving the pin of the eccentric drive 74 of the hair cutting appliance 10 to operatively connect the pivot link (and hence the reciprocating blade 120) to the drive assembly 50. This second end 162 of the pivot link 158 also comprises a pair of cylindrical cavities 164 that carry a pair of metal pegs, the pegs together defining a counter weight 166. The mass and location of the counter weight 166 relative to the pivot axis PA of the pivot link 158 generally correspond functionally to the mass and location of the reciprocating blade (e.g., the cutting blade assembly) 120 such that upon reciprocating pivoting movement of the pivot link (e.g., as driven by the drive assembly 50), the inertial moment generated by the reciprocating blade is substantially counter-balanced by the inertial moment generated by the counter weight 166.

For example, where the mass of the cutting blade assembly 120 of the foil shaver blade head assembly 114 is different from the mass of the reciprocating blade 18 of the trimmer blade head assembly 14 and/or the location of the cutting blade assembly center of mass relative to the pivot axis of the pivot link 158 is different from the location of the reciprocating blade center of mass relative to the pivot axis PA of the pivot link 40, the mass of the counter weight 166 and/or the location thereof relative to the pivot axis of the pivot link 158 is different from that of the counter weight 56 of the head assembly 14 to thereby correspond particularly to the cutting blade assembly 120 (i.e., the reciprocating blade) of the foil shaver blade head assembly 114.

Operation of an appliance 10 with the foil shaver blade head assembly 114 of FIGS. 6, 7A and 7B is otherwise substantially the same as set forth previously for the hair trimmer blade head assembly 14. Thus, it will be understood that by having the counter weights 56, 166 located in the cutting head assemblies 14, 114, the counter weight arrangements (e.g., size and location) can be specifically tailored to the mass/location of the reciprocating blade for which it is designed to counter balance, without having to change the handle 12 and drive assembly 50 of the cutting appliance 10.

Figure 8:
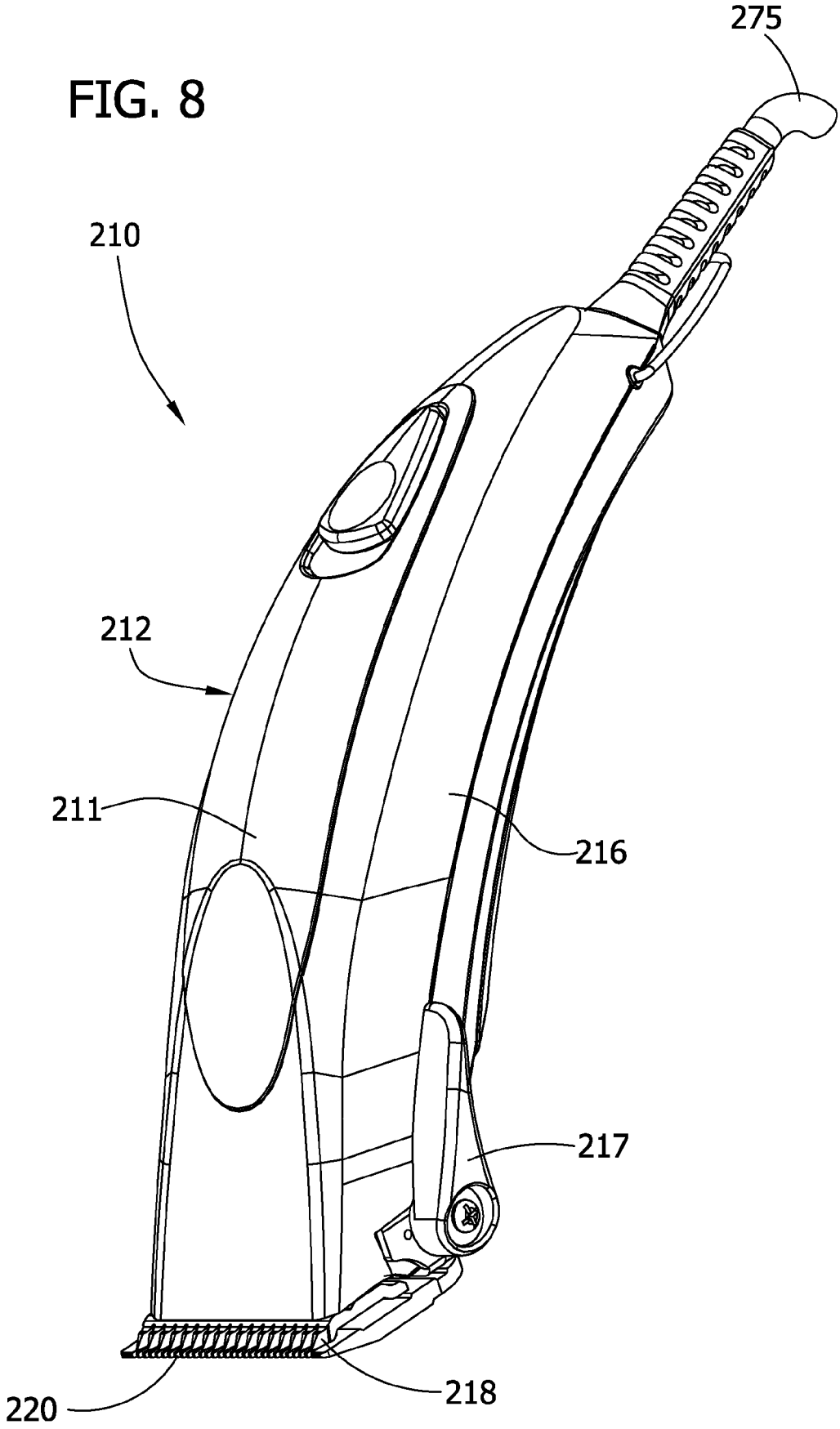
FIG. 8 is a perspective view of a second embodiment of a hand-held hair cutting appliance of the present invention in the form of an electric hair clipper having a handle and a blade head assembly.
Figure 9:
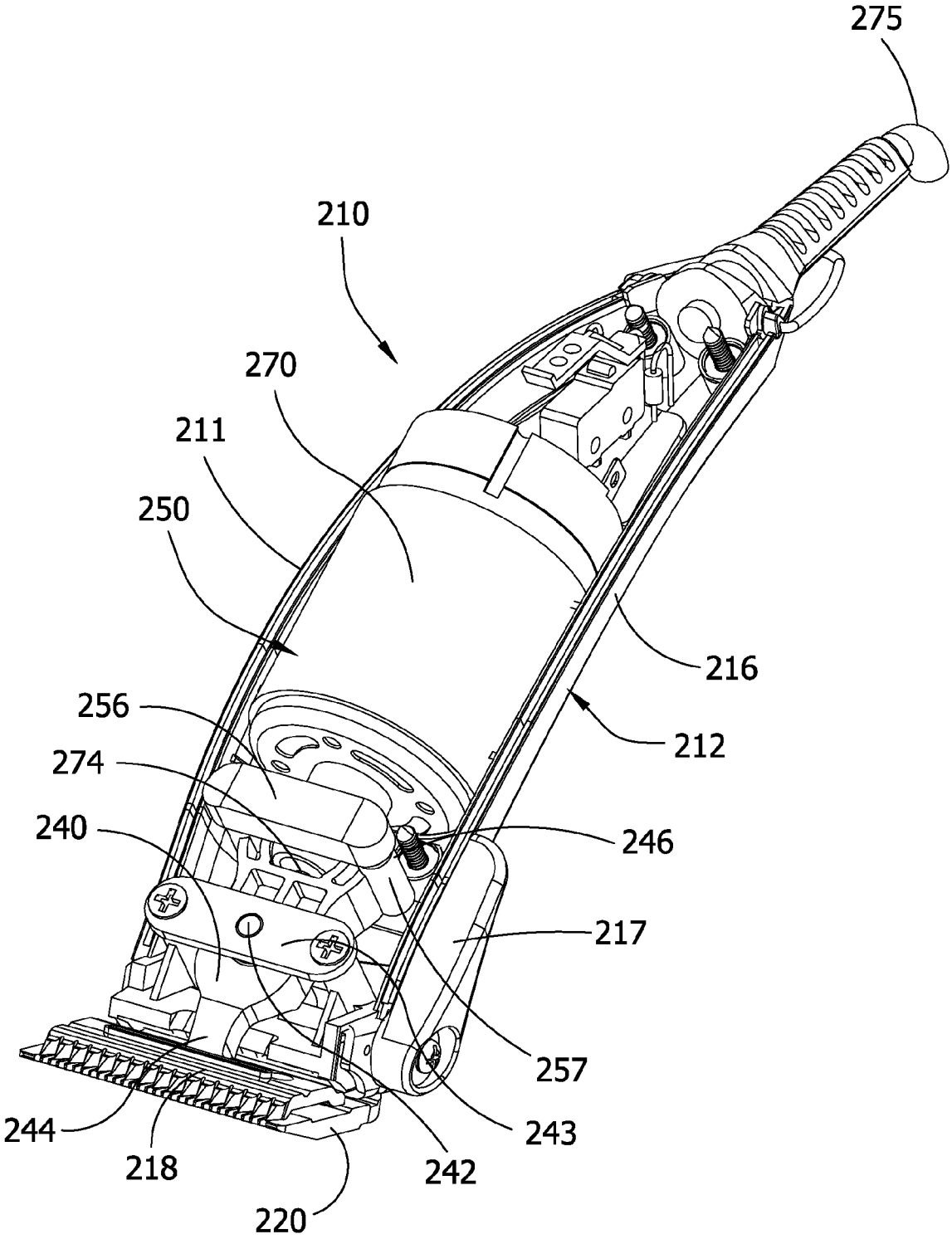
FIG. 9 is perspective view of the hair clipper of FIG. 8 with parts removed to reveal internal construction.

FIGS. 8 and 9 illustrate another embodiment of an electric hand-held hair cutting appliance in the form of hair clippers 210 such as may be used for clipping human or pet hair. The clippers 210 are constructed and operate in a manner similar to the appliance 10 of FIGS. 1-4 with the general exception that a counter weight 256 of this embodiment are housed within a handle 212 of the clippers and are therefore held in assembly with the handle instead of, for example, the blade head assembly 14, 114 of FIGS. 3-6. For example, the clippers 210 still include a pair of cutting blades including a reciprocating blade 218 (broadly, a first cutting blade) and a stationary blade (broadly, a second cutting blade) 220 formed integrally with a cover 216 and positioned in sliding, face-to-face contact with the reciprocating blade. The reciprocating blade 218 is adapted for reciprocating movement relative to the cover 216, and hence the stationary blade 220 to cut hair.

In the illustrated embodiment, the clippers 210 particularly comprise the handle 212 and the cover 216 (the handle and cover together broadly defining a housing 211 of the clippers). The cover 216 is selectively moveable relative to the handle 212 via a lever 217 to adjust the cutting length (e.g., length of hair cut by the clippers) of the clippers 210 (e.g., by adjusting the position of the integrally formed stationary blade 220). A drive assembly 250 including an electric drive motor 270 and eccentric drive 274 similar to the drive assembly 50 of the appliance 10 of FIGS. 1 and 2 are disposed within the handle 212. In this embodiment, the drive motor 270 receives electric power from an external source via a cord 275. However, it is contemplated that the clippers 210 may instead be battery operated (disposable or rechargeable) without departing from the scope of this invention.

A pivot link 240 is pivotally mounted on the clipper housing (and in particular the handle 212) by a suitable pin 242 held by support structure 243 for pivoting movement of the pivot link relative to the housing about a pivot axis defined by the pin in a manner similar to the pivot link 40 of the appliance of FIG. 1. The pivot link 240 has a first longitudinal end 244 pivotally connected to the reciprocating blade 218 to operatively connect the reciprocating blade to the pivot link. The pivot link 246 of this particular embodiment extends longitudinally away from the pivot axis to a second end 246 of the pivot link disposed longitudinally beyond the pin of the eccentric drive 274 as illustrated in FIG. 9. A slot (not shown but similar to the slot 80 of the pivot link 40 of FIG. 3B) is formed in the pivot link longitudinally intermediate the end 246 of the pivot link and the pivot axis defined by the pin 242, suitably adjacent the end of the pivot link. The slot receives the pin of the eccentric drive 274 therein to operatively connect the pivot link (and therefore the reciprocating blade 218) to the drive assembly 250.

As in the previous embodiments, a counter weight 256 is secured to the pivot link 240 to counter-balance the inertial moment generated by reciprocating movement of the reciprocating blade 218. In the illustrated embodiment, suitable mounting structure 257 is provided at (and more suitably formed integrally with) the second end 246 of the pivot link 240 and the counter weight 256 in the form of a bar weight is secured on the pivot link by the mounting structure. The mass and location of the counter weight 256 relative to the pivot axis of the pivot link 240 generally corresponds functionally to the mass and location of the reciprocating blade 218 such that upon reciprocating pivoting of the pivot link (e.g., as driven by the drive assembly 250), the inertial moment generated by the reciprocating blade is substantially counter-balanced by the inertial moment generated by the counter weight 256. It is therefore understood that the counter weight 256 may be located anywhere along the pivot link 240 segment from the pivot axis to the end 246 of the pivot link without departing from the scope of this invention.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A blade head assembly for a hand-held hair cutting appliance, the hair cutting appliance comprising a handle, a drive assembly disposed at least in part within the handle and held in assembly therewith, and the blade head assembly, said blade head assembly being removably attachable to the handle in operative connection with the drive assembly and comprising:

a blade head assembly housing having a front, a back and two opposite sides, a first cutting blade and a second cutting blade, said first and second cutting blades being held in assembly with the blade head assembly housing for attachment and detachment from the handle with the blade head assembly, said first cutting blade being capable of reciprocating translational movement relative to the blade head assembly housing such that the first cutting blade is moveable in a side to side direction relative to the handle and the second cutting blade, the blade head assembly being arranged and configured such that upon attachment of the blade head assembly to the handle of the hair cutting appliance the first cutting blade is operatively connected to the drive assembly; and a counter weight held in assembly with the blade head assembly housing and being adapted for reciprocating movement relative thereto in response to reciprocating translational movement of the first cutting blade to thereby at least partially counter-balance the reciprocating translational movement of the first cutting blade, the blade head assembly being configured for movement of the counter weight in a direction generally opposite to a direction of movement of the first cutting blade.

2. The blade head assembly set forth in claim 1 wherein the counter weight is held in assembly with the first cutting blade for conjoint operative connection of the first cutting blade and the counter weight with the drive assembly upon attachment of the blade head assembly to the handle of the hair cutting appliance.

3. The blade head assembly set forth in claim 2 further comprising a pivot link pivotably connected to the housing for pivoting movement relative thereto about a pivot axis oriented other than in the direction of reciprocation of the first cutting blade, the pivot link being adapted for operative connection to the drive assembly upon attachment of the blade head assembly to the handle of the hair cutting appliance such that the drive assembly reciprocatingly pivots the pivot link about its pivot axis, the first cutting blade and the counter weight each being operatively connected to the pivot link in spaced relationship with the pivot axis such that the pivot link conjointly reciprocates the first cutting blade and the counter weight in response to the pivot link being reciprocatingly pivoted by the drive assembly.

4. The blade head assembly set forth in claim 3 wherein the first cutting blade and the counter weight are arranged relative to the pivot link in operative connection therewith such that the counter weight continually moves in a direction generally opposite to the direction in which the first cutting blade moves upon reciprocating pivoting movement of the pivot link about its pivot axis.

5. The blade head assembly set forth in claim 4 wherein the pivot link is generally elongate and has a longitudinal axis, a first segment extending longitudinally away from the pivot axis on said longitudinal axis and a second segment extending longitudinally away from the pivot axis on said longitudinal axis in a direction opposite the first segment, the first cutting blade being held in assembly with the first segment and the counter weight being held in assembly with the second segment.

6. The blade head assembly set forth in claim 4 wherein first cutting blade, the pivot link and the counter weight together have a center of mass, said center of mass being one of at and adjacent to the pivot axis of the pivot link.

* * * * *